US006086277A

United States Patent [19]

Gutberlet

[11] Patent Number: 6,086,277

[45] Date of Patent: Jul. 11, 2000

[54] COSMETIC PENCIL

[75] Inventor: Horst Gutberlet, Altdorf, Germany

[73] Assignee: h + m gutberlet GmbH, Nürnberg, Germany

[21] Appl. No.: 09/265,377

[22] Filed: Mar. 10, 1999

[30] Foreign Application Priority Data

Mar. 31, 1998 [DE] Germany ..... 298 05 800

[51] Int. Cl.[7] ..... B43K 21/00

[52] U.S. Cl. ..... 401/80; 401/55; 401/92

[58] Field of Search ..... 401/55, 66, 68, 401/80, 81, 82, 92

[56] References Cited

U.S. PATENT DOCUMENTS 4,954,000 9/1990 Gueret ..... 401/68

5,131,773 7/1992 Gueret ..... 401/68

FOREIGN PATENT DOCUMENTS 52-014019 3/1977 Japan .

*Primary Examiner*—Henry J. Recla

*Assistant Examiner*—Huyen Le

*Attorney, Agent, or Firm*—Browdy and Neimark

[57] ABSTRACT

In a cosmetic pencil comprising a filler stick disposed in a sleeve and an elongated basic body with an automatic advance acting on the filler stick for linear displacement of the filler stick out of the sleeve in the direction towards the free tip of the cosmetic pencil, it is provided, with a view to the possibility of one-hand operation, that the automatic advance is an automatic pusher mechanism, the automatic advance cooperating with a thin pin, for instance a wire section, which conventionally corresponds to the lead of a lead pencil and which acts on the rear of the filler stick via a piston section, pushing the filler stick forward, the piston section being sealingly guided by defined frictional engagement in an envelope, such as a sleeve, which envelops the filler stick, this constituting the required filler stick brake.

3 Claims, 1 Drawing Sheet

COSMETIC PENCIL

BACKGROUND OF THE INVENTION

1. Field of the Invention

The invention relates to a cosmetic pencil comprising a filler stick disposed in a sleeve and an elongated basic body having an automatic advance for the linear displacement of the filler stick out of the sleeve in the direction towards the free tip of the cosmetic pencil.

2. Background Art

In conventional cosmetic pencils of the generic type, the automatic advance is formed by a spindle with a rotary type button or by a similar rotary type mechanism. A drawback of these pencils resides in that both hands are needed for handling, one hand holding the body of the cosmetic pencil and the other operating the rotary type button.

In conventional drawing pencils with thin lead refills of graphite or polymer, provision is made for a lead return motion brake which is usually a small rubber washer having a hole and disposed in the drawing tip.

SUMMARY OF THE INVENTION

It is an object of the invention to embody a cosmetic pencil of the type mentioned at the outset such that one-hand operation is ensured, it being possible to equip the pencil also with filler sticks of soft consistency.

According to the invention, this object is attained by the automatic advance being an automatic pusher mechanism, the automatic advance cooperating with a thin pin, for instance a wire section, which conventionally corresponds to the lead refill and which acts on the rear of the filler stick via a piston section, pushing the filler stick forward, the piston section being sealingly guided by defined frictional engagement in an envelope, such as a sleeve, which envelops the filler stick, this constituting the required filler stick brake.

An automatic pusher mechanism of the generic type is known per se from lead pusher pencils and described in detail in Japanese published patent application Sho 52-14019. According to the invention, the filler stick is pushed out safely, it being possible even to use soft filler sticks which are cast into a sleeve for instance upon production of the filler stick.

This design further ensures that an advance motion of the filler stick is implemented by a pushing motion of the thumb of a single hand for the filler stick to be extended out of a guiding and protecting sleeve into a position for application or for a consumption-based, subsequent advance motion.

When the rear button of the pencil is pressed, the closed tongs move the pin forward together with the piston unit, a corresponding stop pushes the tongs out of the guide ring, it opens and the piston unit stops in the front portion of the filler stick tube, retained through frictional engagement by the filler stick brake. When the pressure on the button is released, the opened tongs move backwards in a manner known per se without however moving the pin backwards, then again enclasping the pin in order to implement the next advance job.

By advantage it can further be provided that seal type annular beads encircle between the inside wall of the sleeve which accommodates the filler stick and the outside wall of the piston section.

A simple type of assembly is implemented by the sleeve which accommodates the filler stick or a sleeve enveloping the filler stick being locked into place in the basic body.

Details of the invention will become apparent from the ensuing description of a preferred embodiment, taken in conjunction with the drawing.

DESCRIPTION OF THE PREFERRED EMBODIMENT

Figure 1:
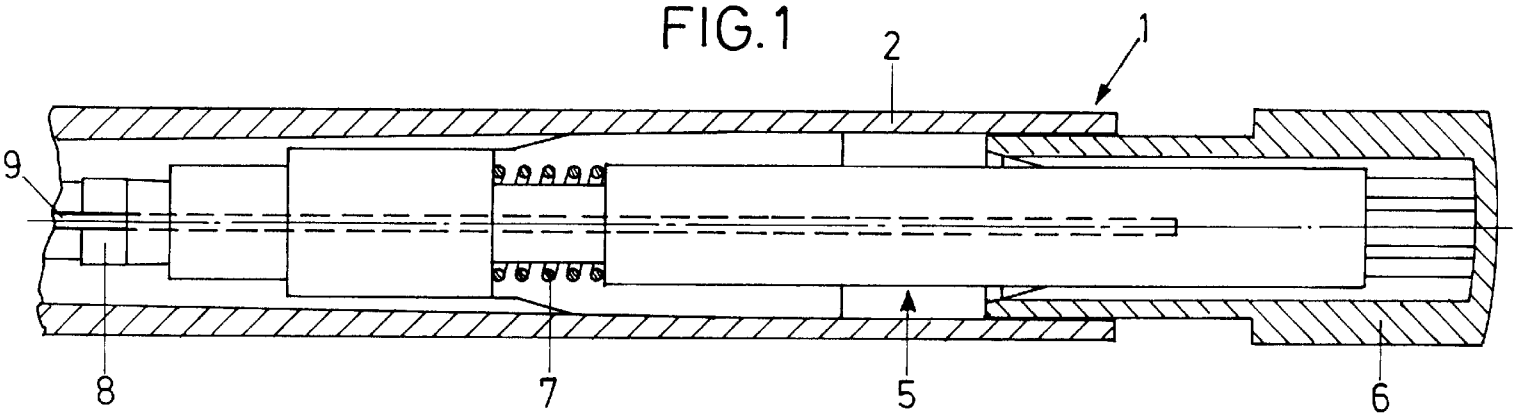
FIG. 1 is an illustration of the backward part of a cosmetic pencil according to the invention comprising an automatic pusher mechanism.

A cosmetic pencil 1 seen in the drawing comprises a sleeve type basic body 2 on which is placed a slip-on cap 3 with an inset mark 4.

FIG. 1 diagrammatically illustrates the automatic pusher mechanism 5 as it is known for the advance motion of lead refills of lead pusher pencils and described in detail for instance in Japanese patent application Sho 52-14019. Of this automatic pusher mechanism the drawing only illustrates the push button 6 which is lengthwise movable relative to the basic body 2, the helical spring 7 and the tongs ring 8, it being possible, by the automatic pusher mechanism 5, to effect an advance V upon each operation of the push button 6.

Unlike a lead pencil, the embodiment under regard transports a steel pin 9 which is tightly connected to a so-called piston section or pomade holder 10. Bead type seals 11, 12 are formed on the piston section 10, externally encircling same, so that the piston section 10 is sealingly displaceable by defined frictional engagement relative to an axially tightly engaged sleeve 13 which is disposed in a bearing sleeve 14 fixed on the basic body 2.

Figure 2:
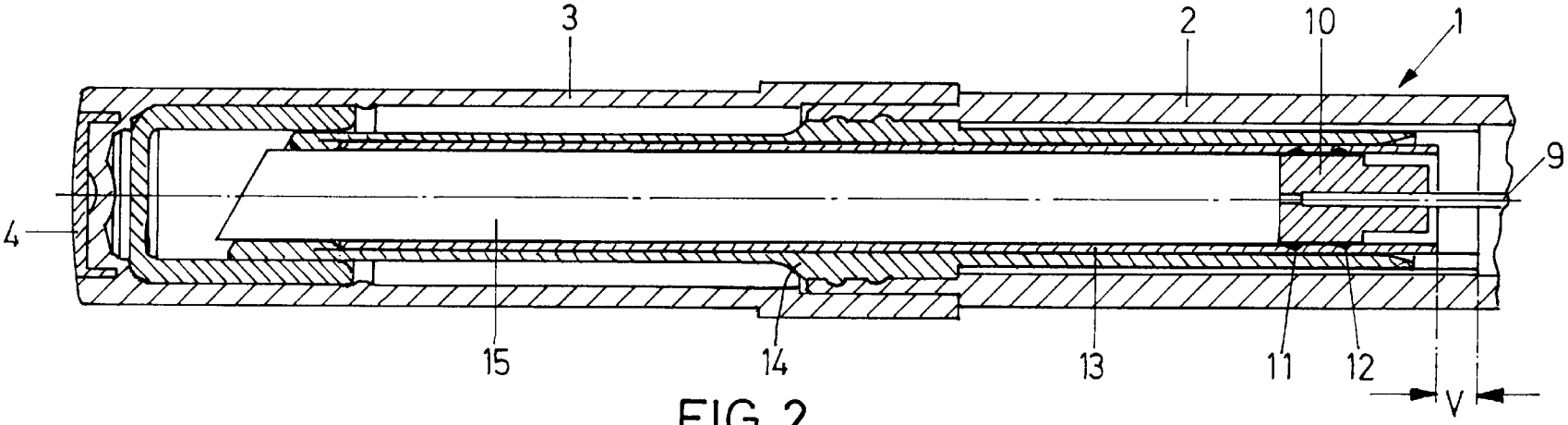
FIG. 2 is a section through the front part which adjoins the left of FIG. 1.

A cosmetic filler stick 15 is disposed in the sleeve 13, which could also be designated as a filler stick sleeve, it being possible, upon actuation of the automatic pusher mechanism 5 via the steel pin 9 and the piston section 10, to push the filler stick 15 forward along the sleeve 13 to the left in FIG. 2, depending on its being increasingly used up.

What is claimed is:

1. A cosmetic pencil comprising a filler stick disposed in a sleeve of an elongated basic body said elongated body having an automatic advance acting on the filler stick to linearly displace the filler stick out of the sleeve in a direction towards a free tip of the cosmetic pencil, wherein the automatic advance is an automatic pusher mechanism (5), the automatic advance cooperating with a thin pin which conventionally corresponds to the lead of a lead pencil and which acts on a rear of the filler stick (15) via a piston section (10) to push the filler stick (15) forward, the automatic pusher mechanism comprising a pair of tongs (8) which close and move the pin forward together with the piston when a rear button of the cosmetic pencil is pressed, wherein when pressure on the button is released, the tongs open while the piston section is retained through frictional engagement by a filler stick brake in the sleeve and the open tongs move backward without moving the pin backwards, thereafter the pin is again engaged by the tongs, the filler stick brake being formed by the piston section (10) sealingly guided by defined frictional engagement in the sleeve enveloping the filler stick (15).

2. A cosmetic pencil according to claim 1, wherein annular beads (11, 12) are provided, encircling between the inside wall of the second sleeve (13) which accommodates the filler stick (15) and the outside wall of the piston (10).

3. A cosmetic pencil according to claim 1, wherein the second sleeve (13) accommodating the filler stick (15) is locked into place in the basic body (2).

* * * * *